US006776117B2

(12) United States Patent
D'Onofrio

(10) Patent No.: US 6,776,117 B2
(45) Date of Patent: Aug. 17, 2004

(54) SIGNAL DEVICE FOR POSITIONING A VEHICLE

(76) Inventor: Shane F. D'Onofrio, 1105 Morris Pl. NE., Albuquerque, NM (US) 87112

( * ) Notice: Subject to any disclaimer, the term of this patent is extended or adjusted under 35 U.S.C. 154(b) by 0 days.

(21) Appl. No.: 10/316,810

(22) Filed: Dec. 11, 2002

(65) Prior Publication Data

US 2003/0112514 A1 Jun. 19, 2003

Related U.S. Application Data

(60) Provisional application No. 60/341,202, filed on Dec. 14, 2001.

(51) Int. Cl.[7] ..... G09F 1/06; G09F 15/00

(52) U.S. Cl. ..... 116/28 R; 40/124.09

(58) Field of Search ..... 116/28 R, 35 R; 33/264; 40/124.09, 124.14, 124.15, 127.19, 539, 672, 674, 610; 446/79, 80, 487, 488; 434/211, 212; 229/92.1, 92.3, 92.8

(56) References Cited

U.S. PATENT DOCUMENTS 286,642 A * 10/1883 Schwartz ..... 40/124.15
1,448,992 A * 3/1923 Bender ..... 40/672
1,705,116 A * 3/1929 Howland ..... 40/120
1,709,831 A * 4/1929 Baker ..... 40/491
2,282,280 A * 5/1942 Yogg ..... 40/124.15
2,397,353 A * 3/1946 Herz ..... 446/488
2,472,166 A * 6/1949 Mathewson ..... 40/124.16
2,881,662 A * 4/1959 Harris ..... 248/472
2,991,699 A * 7/1961 Murray, Sr. ..... 116/63 R
3,007,268 A * 11/1961 Atwater, Jr. et al. ..... 40/124.09
3,174,244 A * 3/1965 Walton ..... 40/774
4,541,190 A * 9/1985 Weiner et al. ..... 40/610
4,813,758 A 3/1989 Sanders ..... 33/286
4,813,902 A * 3/1989 Messer ..... 446/71
4,977,697 A * 12/1990 Genick ..... 40/610
5,127,357 A 7/1992 Viskovich ..... 116/28 R
5,135,157 A * 8/1992 Cruz ..... 229/92.8
5,711,101 A * 1/1998 Mueller et al. ..... 40/750
5,946,834 A * 9/1999 Bradley ..... 40/124.16
6,035,565 A * 3/2000 Capehart ..... 40/121
6,199,287 B1 3/2001 Rankila ..... 33/286
6,385,874 B1 * 5/2002 Tsonas ..... 40/124.09
6,648,293 B1 * 11/2003 Sachnoff ..... 248/460
6,651,367 B1 * 11/2003 Barragan ..... 40/610
2003/0037718 A1 * 2/2003 Randhawa ..... 116/28 R

* cited by examiner

*Primary Examiner*—Diego Gutierrez
*Assistant Examiner*—R Alexander Smith
(74) *Attorney, Agent, or Firm*—DeWitt M. Morgan; Matthew S. Wermager

(57) ABSTRACT

The Signal Device for Positioning a Vehicle, according to the present invention relates to utilizing the peripheral vision of a driver of a vehicle in assessing the proper position of a vehicle relative to a confined parking space. The device is comprised of at least two surfaces, the first obscuring the second until the vehicle has attained the desired position within the parking space. Upon attaining this position, the second surface will come within the operator's field of vision thus notifying the operator to stop the vehicle. Alternately, the operator will stop the vehicle when the second surface obscures the first surface. Additionally, this invention includes a method for parking a vehicle in a confined parking space. Finally, this invention describes a method of distributing advertising and/or solicitation through mass mailing techniques, such advertising accompanying the signal device.

16 Claims, 9 Drawing Sheets

SIGNAL DEVICE FOR POSITIONING A VEHICLE

CLAIM FOR PRIORITY

A claim for priority is made in this application for the provisional application No. 60/341,202 filed on Dec. 14, 2001.

FIELD OF THE INVENTION

The present invention relates generally to the fields of visual signals and visual safety devices. More particularly, the present invention relates to a visual signaling system for enabling a driver of a vehicle to precisely and safely position the vehicle in a parking space, garage or relative to some other objects.

BACKGROUND OF THE INVENTION

Parking a vehicle in a confined space can be difficult. When the vehicle is moved into the space, traveling in either forward or backward direction, the potential exists for the driver to incorrectly estimate the confines of the space in relation to the physical dimensions of the vehicle. The consequence of this is the possibility of contact between the vehicle and other property (wall, garage door, another vehicle, etc.) within close vicinity to the vehicle. This contact may result in damage to the vehicle and/or the other property.

The driver's incorrect estimation is a concern even if the driver is exercising due care. There are several reasons for this. First, it can be difficult to judge the appropriate target position for the vehicle. Factors that are weighed in this judgment include the appropriate amount of space needed for the operation of certain features of the vehicle (car doors, car hoods, car trunks, etc.), the appropriate amount of space needed for the operation of features of property in the vicinity of the vehicle (garage doors, structural doors, etc.), and access to other property (other vehicles, storage, etc.). Second, it is difficult to judge the size of a vehicle while it is being operated. Third, the confined space in which to park the vehicle may be so physically confining that the margin of error for the driver's judgment can be extremely small.

Property damage due to vehicle parking mistakes is also a risk management problem from the point of view of insurance companies. If a way can be found to minimize such accidents, then insurance claims would decrease. A competitive advantage could be realized by an insurance company if they can manage risk for their own policy holders so as to minimize such accidents.

One solution to the problem is to employ the assistance of a separate person not positioned within the vehicle to aid the driver in navigating the vehicle into the appropriate position within the confined space. However, in most instances, this is not a practical solution. Other solutions use range finding devices to convey to the driver the amount of distance between the vehicle and other objects. This solution is cost prohibitive and is not pragmatic. The solution to this problem must be one that is exercisable by the driver alone without any assistance from another person and must be affordable to the average driver.

There have been previous attempts to solve this problem under the above criteria which have employed the use of various devices in order to allow a single driver to appropriately position a vehicle. One example, U.S. Pat. No. 6,199,287 to Rankila, Mar. 13, 2001, discloses a device for positioning a vehicle in a predetermined location. This device is comprised of two spatially separated but conjoined planar surfaces, the first of which is mounted on a wall and the second is extended toward the driver. While this device will assist the driver in positioning the vehicle when the second planar surface is aligned with and obscures a portion of the first planar surface, it has several drawbacks. In its rigid form, the device actually provides another obstruction that could cause damage to a vehicle because the distance required to separate the first and second surfaces must be of more than negligible in order for this device to operate properly (too short of a distance would provide too great of a tolerance in the desired parking position). In its retractable embodiment, the device would require a driver to exit the vehicle in order to reset the device into its operable position before attempting to position the vehicle. This is extremely inconvenient to the driver. Finally this device requires the driver's attention to be focused on the device and not on the pertinent surroundings in the parking space. This lack of attention on the pertinent surroundings could cause more extensive damage than what the device is attempting to correct.

Another example is U.S. Pat. No. 4,813,758 to Sanders, Mar. 21, 1989, which discloses a device for positioning a car in a garage. This device comprises lateral and longitudinal positioning members. Lateral alignment is achieved when the lateral positioning members are aligned. Longitudinal alignment is achieved when the headlights of the vehicle being operated are reflected, through the use of a mirror, into the driver's eyes. This device also has several drawbacks. First, it can only be used when parking in a forward moving direction since it must be mounted on the wall opposite the entry to the parking space. The device could not be mounted on the garage door to allow for backing into the parking space, by virtue of the obvious fact that the garage door must, necessarily, be in the open position to allow for access to the parking space. Secondly, it requires the driver's strict attention to the device to perceive the lateral alignment of the lateral positioning members, thus distracting the driver from the other pertinent surroundings. Thirdly, the operation of the device requires the device to reflect the vehicle's headlights directly into the driver's eyes, thus creating a hazardous situation. Finally, relying on the driver's headlights for alignment may be difficult during the day if the parking space is exposed to light. Also, using headlights during the day increases the opportunity for drivers to leave their headlights on after exiting the vehicle, thus depleting the battery of the vehicle.

Yet another example of a car positioning device is U.S. Pat. No. 5,127,357 to Viscovich, Jul. 7, 1992, which utilizes a mirror mounted on a surface in a garage to reflect light to the side rear-view mirror on a vehicle. The invention operates by reflecting the illuminated brake lights into the side rear-view mirror when the vehicle is properly positioned. The shortcomings of this invention involve requiring the driver's attention to be focused on the rear-view mirror, thus distracting the driver from other pertinent surroundings. In addition, the tolerance of proper positioning is inherently large as the mirrors will reflect all incident light and the driver must judge the magnitude or intensity of the reflected light in order to properly position a vehicle. This could lead to imprecise positioning of the vehicle.

All of the previous attempts do not adequately solve the vehicle positioning problem. Thus, what is needed is a device and method for using that device that 1) helps drivers park their cars more accurately, 2) does not require strict attention to the device, 3) functions properly while a vehicle is traveling in both forward and backward directions, and 4)

provides for moderately precise positioning of a vehicle without creating further hazards in the parking space.

OBJECTS OF THE INVENTION

It is an object of the present invention to provide a way to signal a driver when to stop a vehicle in a parking space without requiring the help of an assistant or expensive technology.

It is yet another object of the present invention to provide a visual signal device that signals a driver when to stop a vehicle in a parking space without requiring the focused attention of the driver to be on the signal device.

It is yet another object of the present invention to provide a visual signal device that signals a driver when to stop a vehicle in a parking space that can be utilized while traveling in either forward or backward directions.

It is yet another object of the present invention to provide a visual signal device combined with a medium for visual advertising.

It is still yet another object of the present invention to provide a visual signal device that works in poorly-lighted conditions as well as well-lighted conditions.

It is still yet another object of the present invention to provide an adjustable visual signal device that signals a driver when to stop a vehicle in a parking place when that vehicle is properly positioned.

It is a further object of the present invention to provide a visual signal device that will not damage a vehicle if that vehicle collides with the device.

It is a further object of the present invention to provide a system that helps drivers park their vehicles more accurately, which can be mass distributed at an economically reasonable cost.

The foregoing and other objects will be apparent from the drawings and the description set forth herein.

SUMMARY OF THE INVENTION

This invention relates to a visual signal device that aids a driver of a vehicle to position that vehicle in a precise location. The signal device allows the driver to use his peripheral vision to properly position the vehicle. The signal device is positioned on a wall or other structure adjacent a parking space, where such wall or other structure has a surface that is at least approximately parallel to the direction of travel of the vehicle. In one embodiment, as a vehicle first travels into the parking space, the proximal side of the device obstructs the distal side of the device and, therefore, only the proximal side is within the driver's field of view. Upon attaining the optimal position within the parking space, the distal side of the device comes within the driver's field of vision, engaging the driver's peripheral vision, and signaling the driver to stop the vehicle. The proximal and distal sides of the device are of colors and/or materials such that the contrast between the proximal and distal sides is readily apparent. In a different embodiment, as the vehicle first travels into the parking space, both the proximal and distal sides are within the driver's field of view. Upon attaining the optimal position within the parking space, the proximal side of the device disappears from the driver's field of view signaling the driver to stop the vehicle. The proximal and distal sides of the device are of such colors and/or materials that again, the contrast between the proximal and distal sides is readily apparent. These proximal and distal sides can be formed by folding the device along designated lines or manipulating the device using multiple layers of signal surfaces The invention, when placed in operational configuration, is entirely passive as there are no moving parts. The stop signal is effective simply by the movement of the car relative to the stationary device such that either the distal side suddenly is within the field of view of the driver or the proximal side disappears from the field of view of the driver when the vehicle attains an optimal position within the parking space.

The invention is uniquely advantageous over the prior art in that it is converted from a shipping configuration to the operational configuration with relative ease. The shipping configuration is such that it can be mass mailed and is no larger nor heavier than an ordinary mailer of conventional size. The invention converts from the shipping configuration to the operational configuration by manipulation of the various surfaces. Some embodiments require at least one folded surface to be releasably attached to the mounting surface surfaces in order to function appropriately while in operational formation. The invention is further advantageous in that the material of the device is of such a quality so that it remains durable when attached to wall in the operational configuration but does not provide any additional obstacles within the parking space nor is capable of causing damage to the vehicle if a driver improperly negotiates the parking space.

DESCRIPTION OF THE PREFERRED EMBODIMENTS

Figure 1:
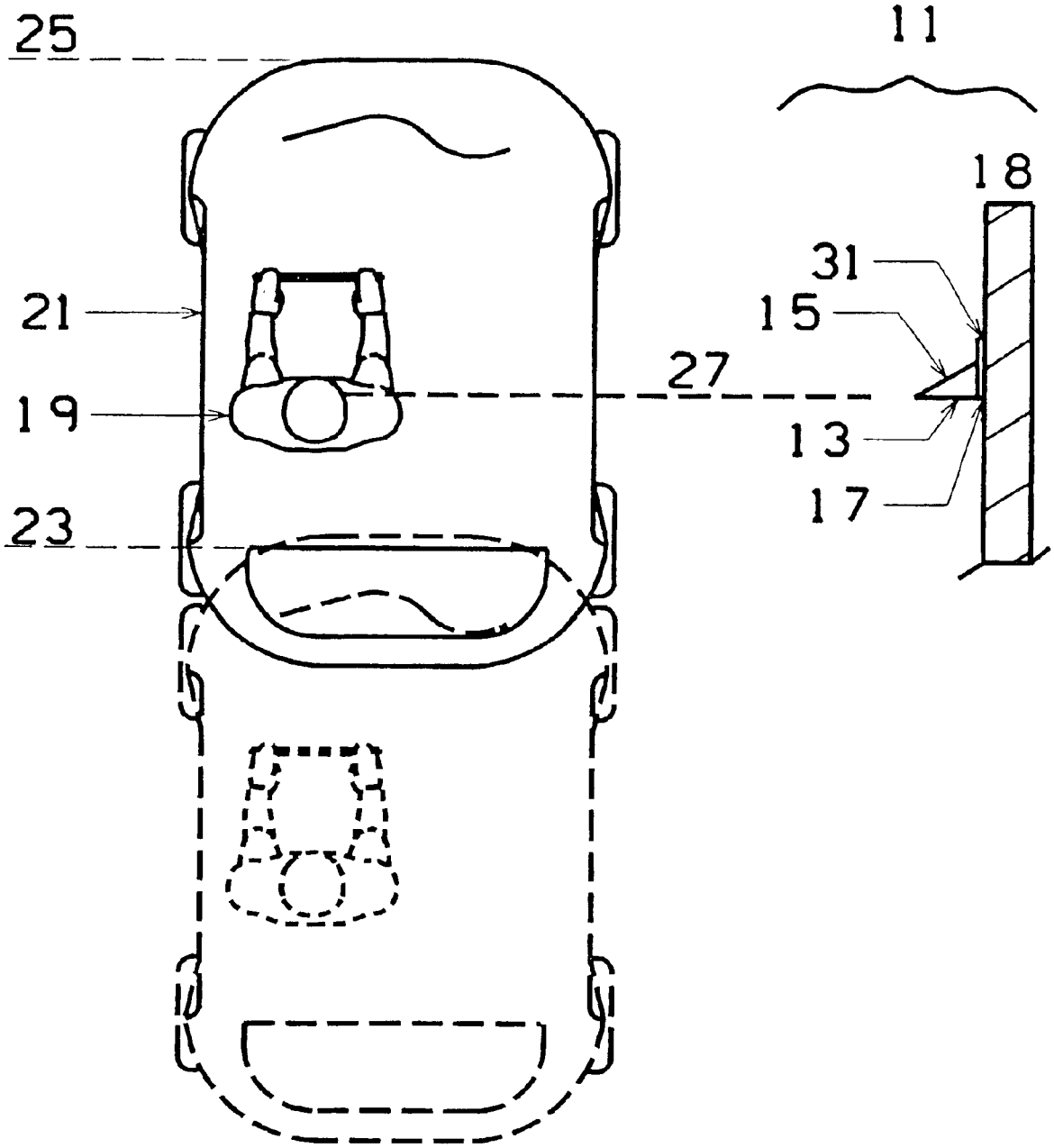
FIG. 1 illustrates a top plan view of the operational formation of the signal device according to various embodiments of the present invention with a vehicle traveling in a forward direction.
Figure 2:
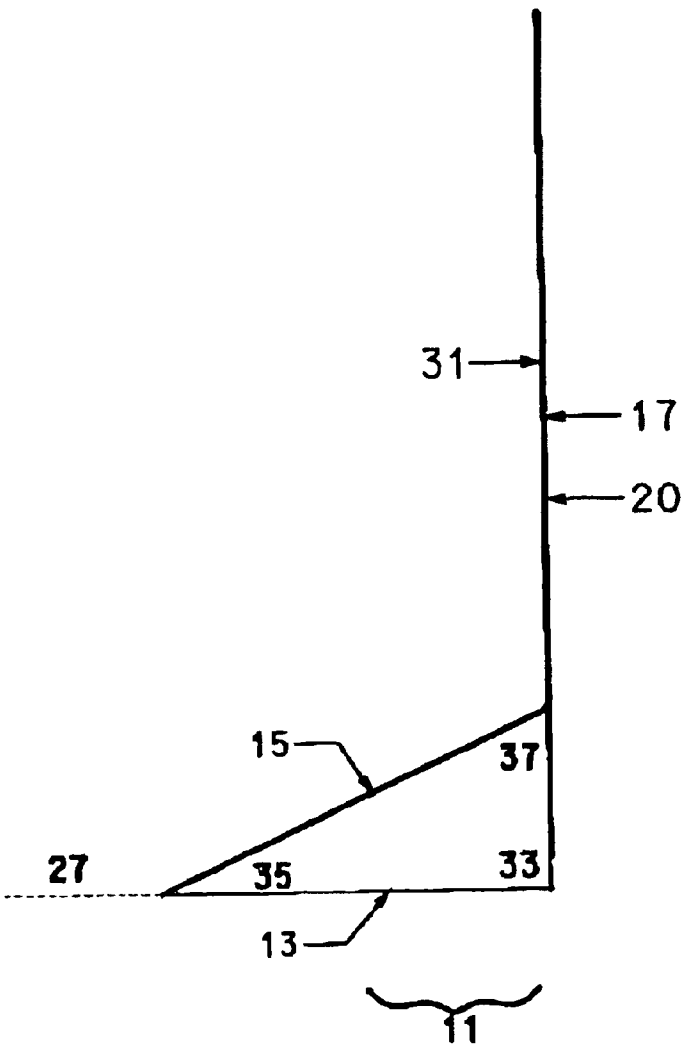
FIG. 2 illustrates a top view of the signal device according to a first embodiment of the present invention.

FIG. 1 illustrates one embodiment of the signal device 11 in its operational formation. The signal device 11 comprises a proximal surface 13, a distal surface 15, a mourning surface 17, and a graphic display surface 31. The mounting surface 17 of the signal device, which is shown in more detail with reference to FIG. 2, is engaged with an opposing surface 18 through the use of any adhesive 20 which is known in the art. The signal device 11 is mounted at a height such that it can be viewed by a driver 19, having a seated position within a vehicle 21. This height is such that any information contained on the graphic display surface 31 will be prominently displayed within the confined parking space. The use of graphic display surface 31 is further discussed with reference to FIG. 2. Further the signal device 11 is longitudinally mounted such that when the vehicle 21 is positioned appropriately within the confined parking space, the driver 19 is able to recognize a contrast in color and/or material between proximal surface 13 and distal surface 15.

With further reference to FIG. 1, driver 19 of vehicle 21 traverses a confined parking space in a forward motion. In first position 23, the driver 19 only has the ability to see the proximal surface 13 and not the distal surface 15 of signal device 11. The driver 19 then navigates the vehicle 21 to a second position 25. Second position 25 represents the precise position in which color and/or material contrast between the proximal surface 13 and the distal surface 15 of the signal device 11 first comes into said driver's field of view, represented by peripheral view line 27. Upon reaching position 25, the driver 19 will stop the vehicle 21, which will be properly positioned in the confined parking space.

In an alternate embodiment, with further reference to FIG. 1, driver 19 will have the ability to see both proximal surface 13 and distal surface 15 at first position 23. The driver 19 then navigates the vehicle 21 to second position 25. Second position 25, in this embodiment, represents the precise position in which proximal surface 13 is no longer within the field of view of driver 19. In both embodiments, proximal surface 13 is substantially perpendicular to mounting surface 17. The two embodiments above differ in the value of the interior angles formed by proximal surface 13, distal surface 15, and mounting surface 17. These angles are discussed in detail with reference to FIG. 2.

FIG. 2 illustrates a top view of the signal device in operational formation. Distal surface 15 is obscured from vision by proximal surface 13 of the signal device until a driver (not shown) attains the peripheral view line 27. FIG. 2 further illustrates mounting surface 17 which can be affixed to a wall or other structure (not shown). This affixation is accomplished thought the use of any adhesive (not shown) which is known in the art. FIG. 2 further illustrates the use of a display surface 31, which is adjacent distal surface 15. This display surface is useful as advertisement, solicitation or promotional space. This use of space for advertising aids in maintaining a prominent profile for the company that bears the cost of manufacturing and/or distributing the signal device. Additionally, or as an alternative, the display space is useful to convey any message, for example a public service message or a safety encouragement.

FIG. 2 further illustrates the angles formed by surfaces 13 and 15 when in operational formation according to this embodiment. Signal device 11 comprises first, second, and third angles, 33, 35, and 37. The first angle 33 formed by the proximal surface 13 and the mounting surface and is substantially 90°. The second angle 35 formed between proximal surface 13 and distal surface 15 can vary from between 0° and 90°. Finally the third angle 37 formed between the distal surface 15 and the mounting surface 17 can vary from between 0° and 90°. As is shown, FIG. 2, angles 35 and 37 must cumulatively equal approximately 90°. In order for proximal surface 13 to obscure distal surface 15 from being within the field of view of the driver 19 (not shown), according to one embodiment, angle 35 must be relatively small as compared to angle 37. In this embodiment, the device will function by signaling the driver 19 (not shown) to stop vehicle 21 (not shown) when distal surface first comes into the field of view of driver 19 (not shown). As angle 35 becomes larger, and angle 37 becomes correspondingly smaller, it is more likely that distal surface 15 will be within the field of view of driver 19 (not shown) upon first entering a parking space, thus relating to a different embodiment. In this different embodiment, the device will function by signaling the driver 19 (not shown) to stop the vehicle 21 (not shown) when proximal surface 13 first disappears from the field of view of driver 19 (not shown).

Figure 3:
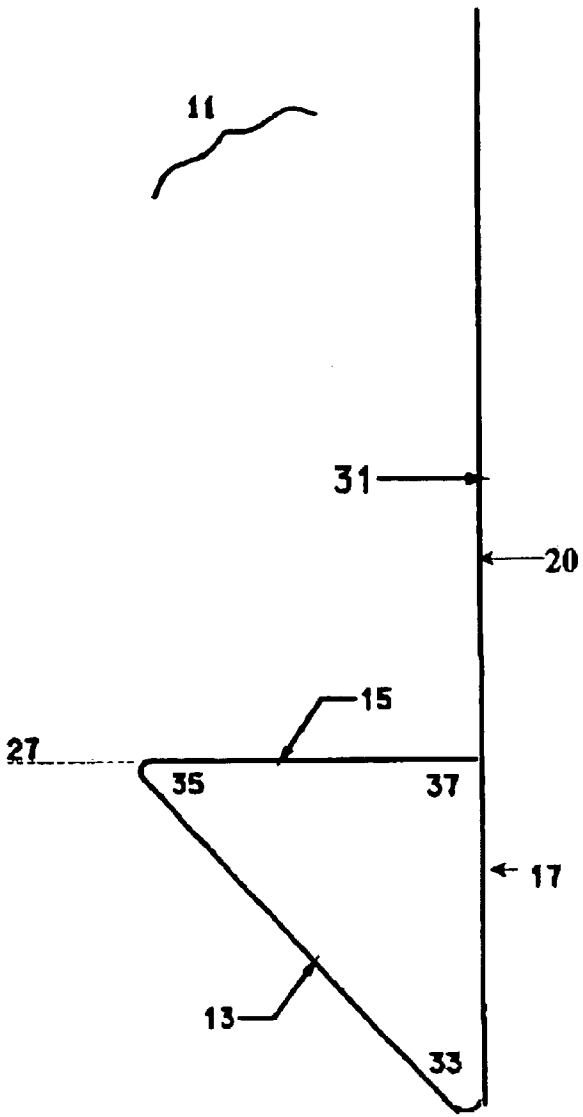
FIG. 3 illustrates a top view of the signal device according to a second embodiment of the present invention.

FIG. 3 is an illustration of an alternate embodiment of the present invention. As shown in FIG. 3, third angle 37 is substantially 90° and angles 33 and 35 vary from between 0° and 90° and cumulatively equal approximately 90°. In this embodiment, the device will function by signaling the driver 19 (not shown) to stop vehicle 21 (not shown) when distal surface first comes into the field of view of driver 19 (not shown).

Figure 4:
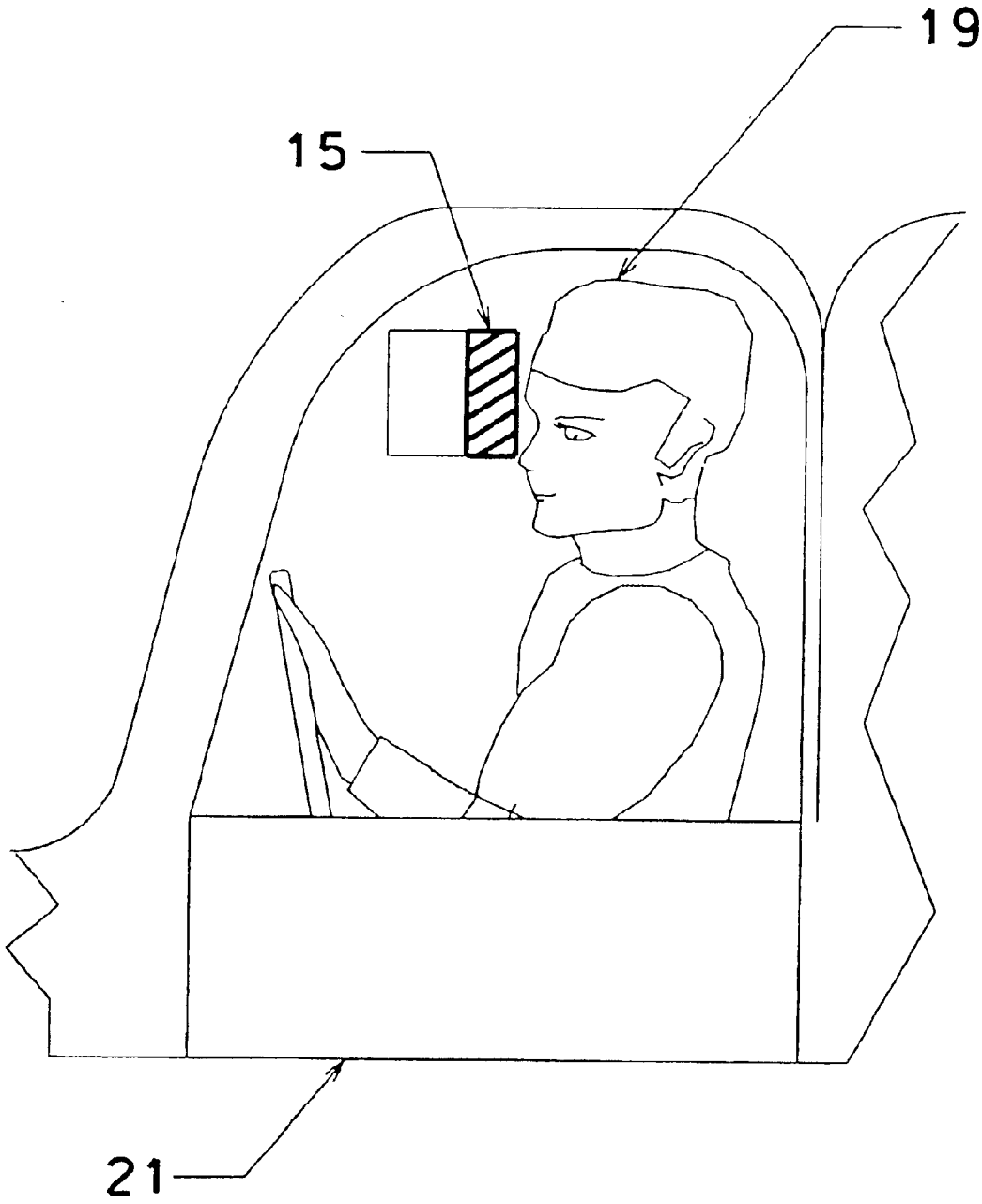
FIG. 4 illustrates the use of the device when in operational formation as attached to a opposing surface.

FIG. 4 is a cut away view of a driver 19 in a vehicle 21 after the vehicle 21 is navigated to second position 25 (not shown) where the distal portion 15 of the signal device 11 is just visible to driver 19, thus signaling to driver 19 that vehicle 21 has attained an appropriate stopping position.

Figure 5:
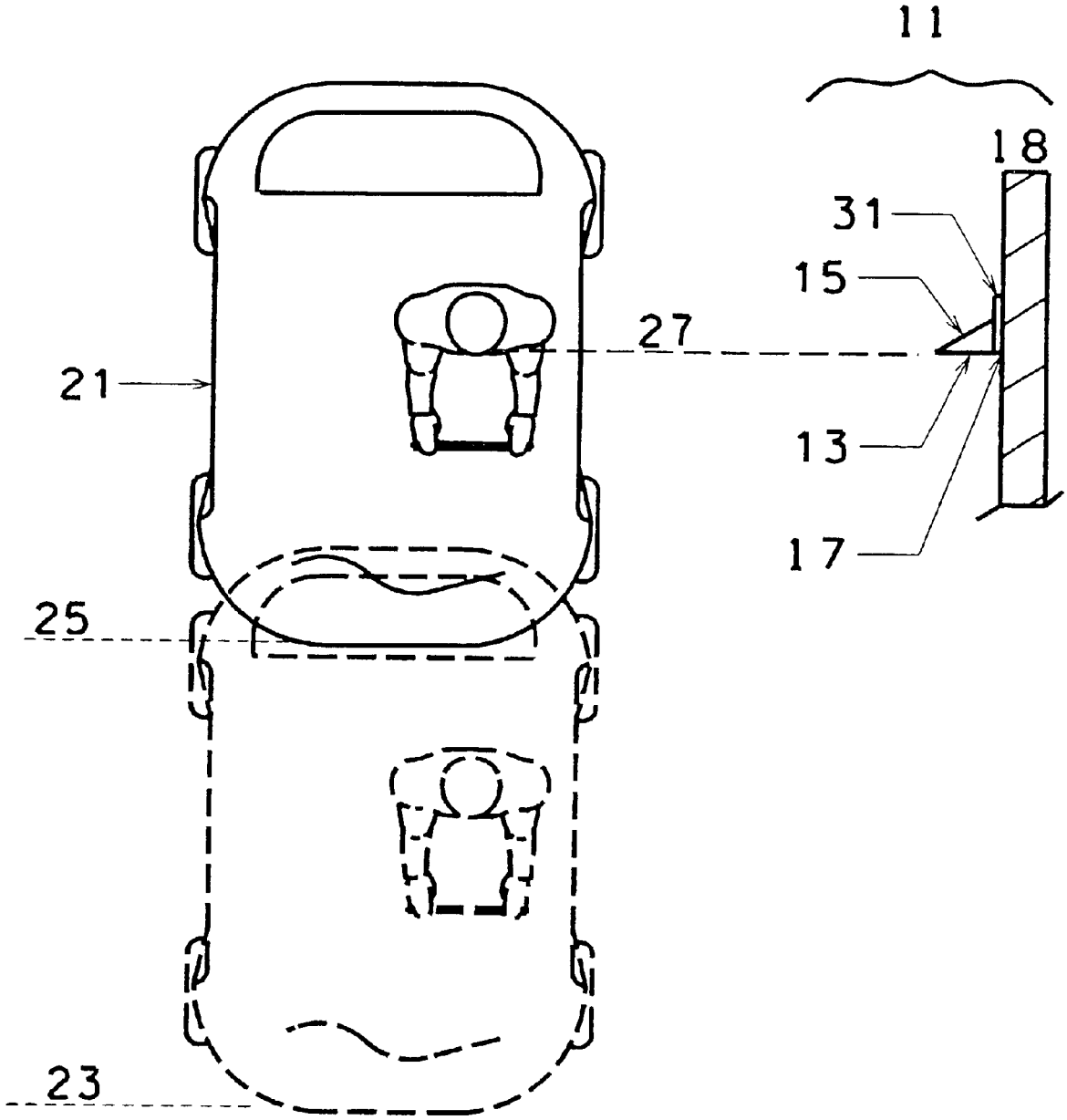
FIG. 5 illustrates a top plan view of the operation of a signal device according to various embodiments of the present invention with a vehicle traveling in a backward direction.

FIG. 5 illustrates the invention of FIG. 1 with the modification that the driver and vehicle are traversing the confined parking space in a backward motion from a first position 23 to a second position 25. The height of the device will remain constant but the device will be longitudinally mounted in a different location in order to assure proper positioning of the vehicle within the confined parking space. Signal device 11 functions in precisely the same manner according to one embodiment described above in that at the instant the distal surface 15 of the signal device 11 comes within the driver's peripheral view line 27, the vehicle will be properly positioned within the confined parking space.

Figure 6A:
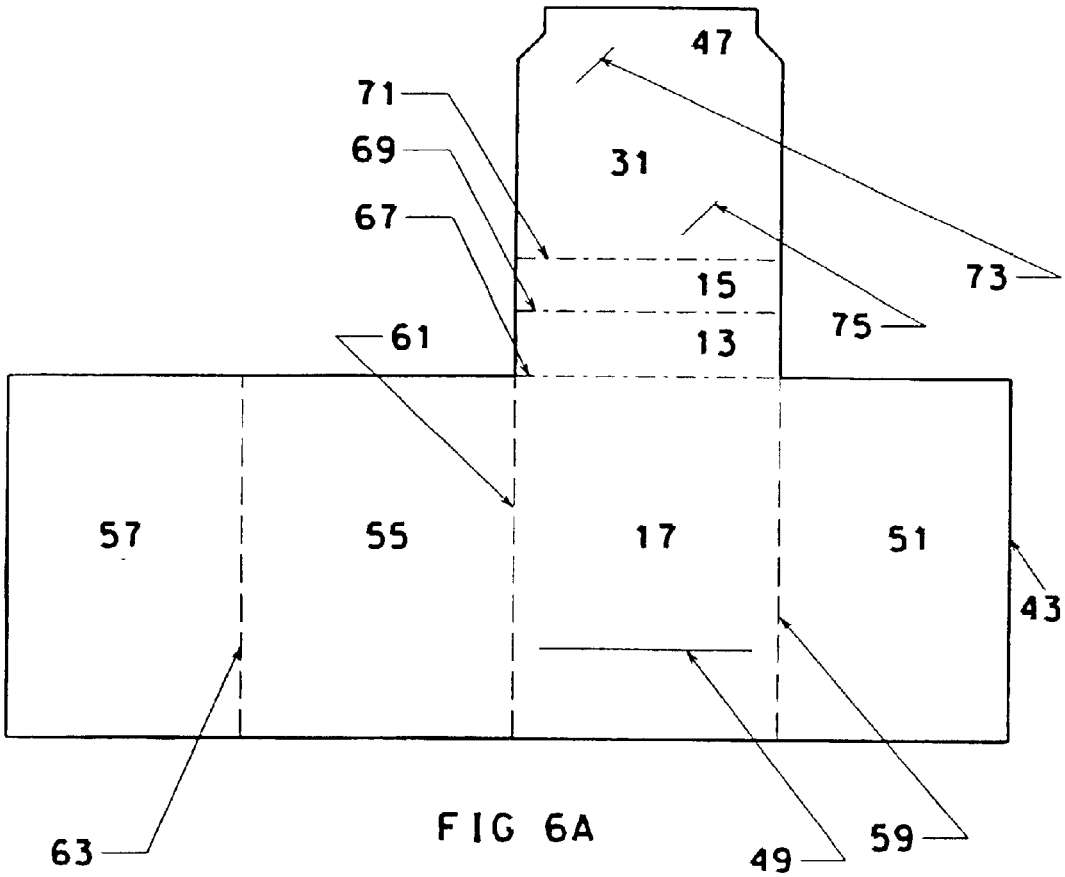
FIG. 6A illustrates a lay-out view of a first side of the invention in the unfolded shipping formation.
Figure 6B:
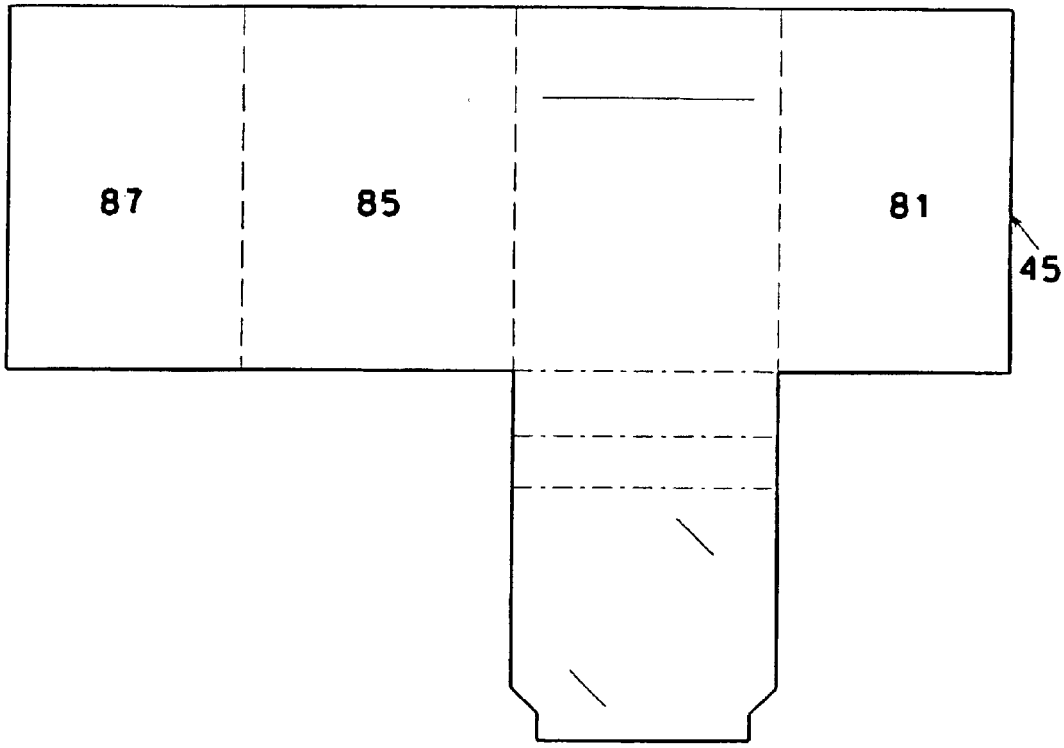
FIG. 6B illustrates a lay-out view of a second side of the invention in the unfolded shipping formation.

FIGS. 6A and 6B illustrate the shipping formation of the signal device 11 in its completely unfolded shipping (or storage) configuration. The shipping formation of the signal device includes first and second surfaces, 43 and 45 respectively. First surface 43 includes proximal surface 13, distal surface 15 as disclosed with reference to FIG. 1, and display surface 31 as disclosed with reference to FIG. 2. First side 43 also includes a tab 47. Tab 47 is of a shape such that it will engage and become detachably connected to slot 49 when the signal device 11 is in its operational formation. First side 43 additionally includes surfaces 51, 55, and 57. These surfaces can be used for the display of various information, including but not limited the return address for a business reply card, directions of on the use of the signal device, or any promotional advertising and/or logo.

FIG. 6A further illustrates that first surface 43 of signal device 11 is perforated along three perforation lines 59, 61, and 63. These perforation lines, as is known in the art, are used to easily separate two previously conjoined portions of the signal device 11. Therefore, surfaces 51, 55 and 57 can be separated from the remainder of the signal device before the device is manipulated into its operational formation. FIG. 6A further illustrates fold lines 67, 69, and 71 by which a recipient of the signal device in the shipping formation will fold the device. In an alternate embodiment, fold line 71 can be eliminated such that, when in its operational formation, surfaces 15 and 31 will be substantially planar. In this embodiment, surfaces 15 and 31 may be of substantially the same color and/or material. First side 43 can be further configured to contain slots 73 and 75. Slots 73 and 75 are positioned on surface 31 such that a normally sized business card can fit between the slots. Finally, first side 43 includes mounting surface 17 as disclosed with reference to FIGS. 1 and 2.

As illustrated in FIG. 6B, second side 45 is the opposite side of first side 43 and therefore maintains the many of the same attributes as first side 43. Tab 47, slot 49, perforation lines 59, 61, and 63, fold lines 67, 69, and 71, and slots 73 and 75 are in the same position as disclosed with reference to first side 43 of the signal device 11 and are therefore not shown. Second side 45 further includes surfaces 81, 85, 87. These surfaces can be used for, but are not limited to, the display of advertising, promotional logos, survey questionnaires, and addresses of recipients of the signal device 11. Because surfaces 81, 85 and 87 are simply the reverse side of surfaces 51, 55 and 57, they can be separated from the remainder of the device as discussed above with reference to FIG. 6A. If the manufacturer of the device should wish to place a survey questionnaire in the signal device, the questionnaire must be directly opposite the business reply address as disclosed with reference to side 43 in FIG. 6A.

Figure 7:
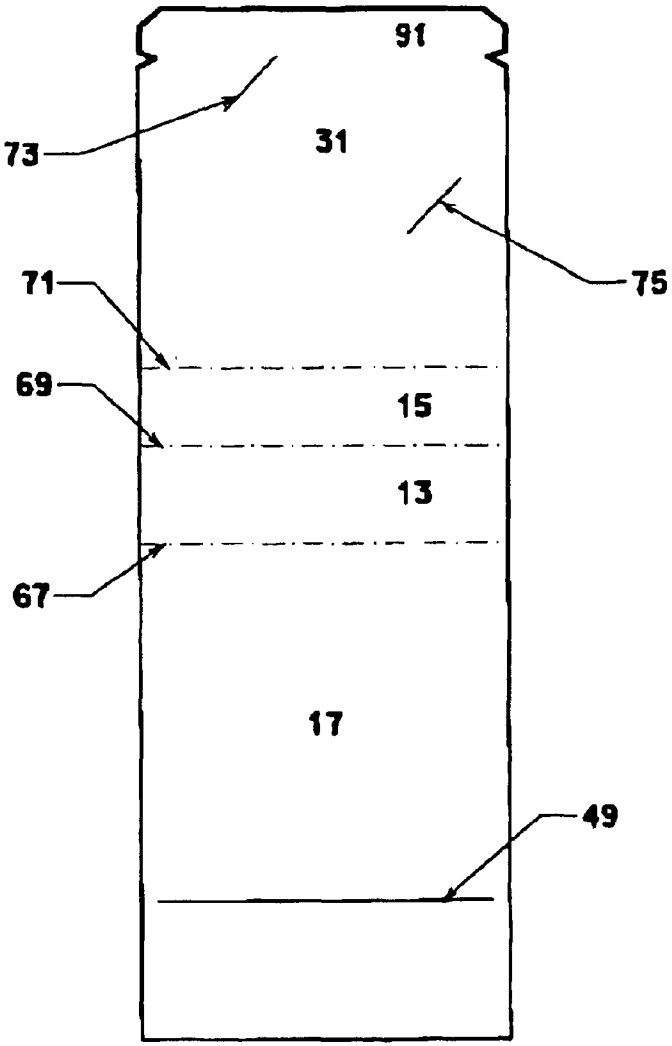
FIG. 7 illustrates a close up view of the locking mechanism used to convert the invention from shipping formation to operational formation.

FIG. 7 is a detailed view of the portion of the signal device 11. More particularly, FIG. 7 shows an alternate embodiment of the attaching mechanism of the signal device 11. Tab 91 is used to engage slot 49 of the signal device 11 instead of tab 47 which is disclosed with reference to FIGS. 6A and 6B. All other features of the invention in this embodiment are identical to those disclosed with reference to FIGS. 6A and 6B.

Figure 8:
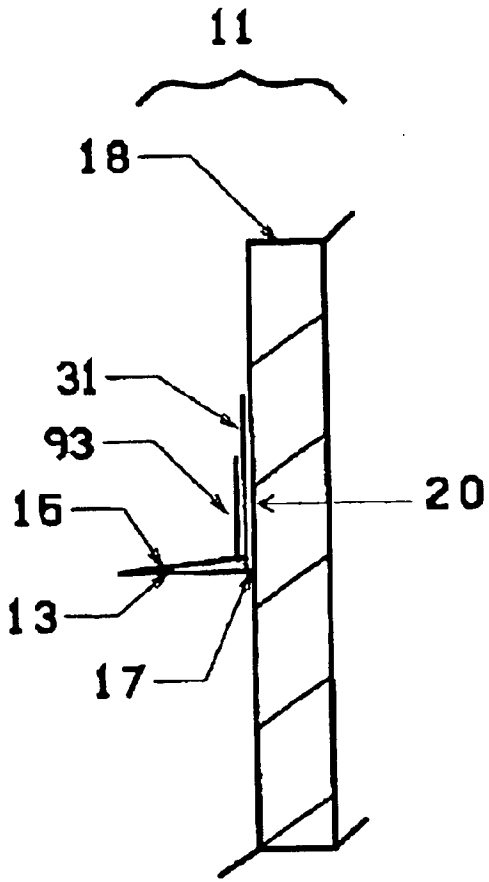
FIG. 8 illustrates a cross sectional view of the signal device according to a third embodiment of the present invention.

FIG. 8 illustrates still another embodiment of the present invention. With reference to FIG. 8, proximal surface 13 and distal surface 15 are disposed such that they are substantially co-planar with each other and substantially perpendicular with mounting surface 17. In addition, FIG. 8 illustrates the use of a third surface 93. Third surface 93 is adjacent distal surface 15, substantially co-planar with mounting surface 17, and, thus substantially perpendicular with surfaces 13 and 15. Third surface 93 can be of the same color of distal surface 15 or can be a third color. In operation, this alternate embodiment will function in such a way that as a driver 19 (not shown) of a vehicle 21 (not shown) enters a parking space, only proximal surface 13 will be visible. Upon attaining an the desired second position 25, distal surface 15 and third surface 93 will some within the driver's field of view thus signaling to driver 19 (not shown) to stop the vehicle 21 (not shown).

Figure 9:
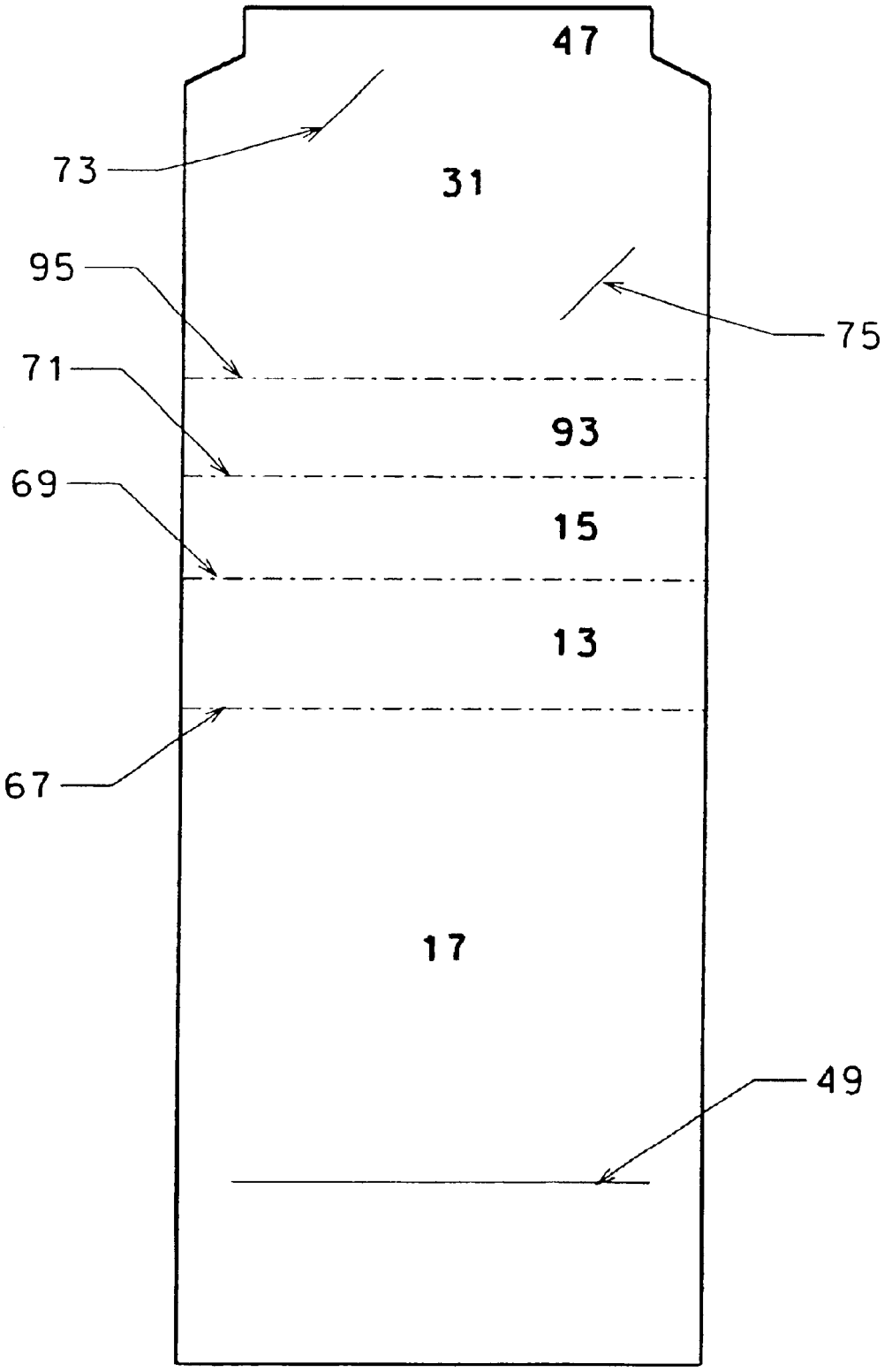
FIG. 9 illustrates a close up view of the device of FIG. 8 in the unfolded shipping formation.

FIG. 9 illustrates the embodiment as discussed with reference to FIG. 8 above in the unfolded or storage configuration. Surface 93 is adjacent distal surface 15 and graphic display surface 31. Line 95 distinguishes between surface 93 and graphic display surface 31. All other features of the invention in this embodiment are identical to those disclosed with reference to FIGS. 6A and 6B.

Whereas the drawings and accompanying description have shown and described the preferred embodiments, it should be apparent to those skilled in the art that various changes may be made in the form of the invention without affecting the scope thereof.

What is claimed is:

1. A signal device for providing a visual parking signal to a driver of a vehicle, the signal device comprising:

a first signal surface;

a second signal surface having a connection to the first signal surface;

the first signal surface having a first color that ends at said connection, the second signal surface having a second color that ends at said connection;

said second color contrasting visually with the first color to provide a clear visual distinction of the first and second signal surfaces from one another;

a mounting substrate, one of said first and second signal surfaces being connected to said mounting substrate at a first location, the other of said first and second signal surfaces capable of being detachably connected to said mounting substrate at a second location whereby said first and second surfaces are moveable from a first configuration where they are substantially planar relative to each other and said mounting substrate to a second configuration where at least one of the first and second surfaces is disposed substantially perpendicular to said mounting substrate;

means for attaching at least one of said first and second signal surfaces to said mounting surface at said second location; and means for affixing said mounting substrate to an opposing vertical surface.

2. The signal device of claim 1, further comprising at least one graphic display surface.

3. The signal device of claim 2, wherein said at least one graphic display surface comprises advertising information.

4. The signal device of claim 2, wherein said at least one graphic display surface comprises a reply mailing.

5. The signal device of claim 2, wherein said at least one graphic display surface comprises directions for assembly of said signal device.

6. The signal device of claim 2, wherein said at least one graphic display surface is detachably connected to said mounting substrate.

7. The signal device of claim 2, wherein said mounting substrate and said signal surfaces can be folded flat for mailing.

8. The signal device of claim 7, wherein said at least one graphic display surface can be folded flat for mailing.

9. The signal device of claim 1, wherein the second signal surface can include both said second color and a graphic display surface.

10. The signal device of claim 1, wherein said first signal surface is disposed at substantially a 90° angle relative to said mounting substrate, and the angle formed by said first and second signal surfaces and the angle formed by said second signal surface and said mounting substrate are cumulatively substantially 90°.

11. The signal device of claim 1, wherein said second signal surface being disposed at substantially a 90° angle relative to said mounting substrate. and the angle fanned by said first and second signal surfaces and the angle formed by said first surface and said mounting substrate are cumulatively substantially 90°.

12. The signal device of claim 1, wherein said first and second signal surfaces are substantially perpendicular to said mounting substrate and a third surface which is adjacent said second surface and is co-planar with mounting surface, said third surface having a color selected from a group consisting of said second color and a third color.

13. The signal device of claim 1, wherein said first color is substantially darker than said second color.

14. The signal device of claim 13, wherein said second signal surface is reflective.

15. The signal device of claim 13, wherein said second signal surface is luminescent.

16. The signal device of claim 13, wherein said second signal surface is fluorescent.

* * * * *